US008072316B2

(12) United States Patent
Mannke, Jr.

(10) Patent No.: US 8,072,316 B2
(45) Date of Patent: Dec. 6, 2011

(54) TABLE ACCESSORY FOR SIGNALING THAT SERVICE IS REQUIRED

(76) Inventor: Regis A. Mannke, Jr., Pittsburgh, PA (US)

( * ) Notice: Subject to any disclaimer, the term of this patent is extended or adjusted under 35 U.S.C. 154(b) by 895 days.

(21) Appl. No.: 11/880,949

(22) Filed: Jul. 25, 2007

(65) Prior Publication Data

US 2009/0027226 A1 Jan. 29, 2009

(51) Int. Cl.

| | |
|---|---|
| ***G08B 5/36*** | (2006.01) |
| ***G08B 5/00*** | (2006.01) |
| ***H05B 39/00*** | (2006.01) |
| ***H05B 41/00*** | (2006.01) |
| ***F21S 10/00*** | (2006.01) |
| ***F21S 8/08*** | (2006.01) |

(52) U.S. Cl. ..... 340/286.09; 340/332; 116/202; 362/410; 362/414

(58) Field of Classification Search ..... 340/286.09, 340/332; 116/202; 362/410, 414
See application file for complete search history.

(56) References Cited

U.S. PATENT DOCUMENTS

| | | | | |
|---|---|---|---|---|
| 1,674,228 | A * | 6/1928 | Schmidt | 116/312 |
| 3,990,166 | A * | 11/1976 | Nagelkirk | 40/442 |
| 4,250,491 | A * | 2/1981 | Dotson | 340/321 |
| 5,489,887 | A * | 2/1996 | Porras | 340/332 |
| D374,834 | S * | 10/1996 | Rusch | D10/114 |
| 5,597,275 | A * | 1/1997 | Hogan | 408/239 R |
| 5,699,039 | A * | 12/1997 | Korzen | 340/311.2 |
| D407,659 | S * | 4/1999 | Utrera | D10/114 |
| 6,164,796 | A * | 12/2000 | La Chiusa | 362/122 |
| 7,048,433 | B1 * | 5/2006 | Bhavnani et al. | 368/316 |
| 7,369,039 | B1 * | 5/2008 | Knutson | 340/332 |
| 7,817,058 | B2 * | 10/2010 | Waterhouse | 340/815.4 |
| 2003/0128629 | A1 * | 7/2003 | Stevens | 368/23 |
| 2005/0077999 | A1 * | 4/2005 | Alexander | 340/286.09 |
| 2005/0151664 | A1 * | 7/2005 | Kolish et al. | 340/815.45 |

* cited by examiner

*Primary Examiner* — Brent Swarthout
*Assistant Examiner* — Andrew Bee
(74) *Attorney, Agent, or Firm* — James Ray and Assoc. LLC

(57) ABSTRACT

An apparatus for providing a silent signal to a waiter/waitress that one of service is required and service is not required. The apparatus comprises a base member having a first predetermined shape and formed of a first predetermined material. A signaling member is engageable with the base member and has a second predetermined shape and is formed of a second predetermined material. There is a connecting member for engaging such signaling member to the base member.

15 Claims, 2 Drawing Sheets

TABLE ACCESSORY FOR SIGNALING THAT SERVICE IS REQUIRED

FIELD OF THE INVENTION

The present invention relates, in general, to a table accessory, and, more particularly, the present invention relates to a table accessory for use in a restaurant that is used to signal the waiter/waitress that service is required or that no service is needed so as to eliminate unneeded intrusions by such waiter/waitress.

BACKGROUND OF THE INVENTION

Everyone has been in a restaurant and has experienced at one time or another a waiter/waitress who has never checked at the table to see if there was need for a coffee refill or any other need. The waiter/waitress was only evident to take and deliver the order and to present the check. On the other hand everyone has experienced a waiter/waitress who is stopping at the table every few minutes to see if there is a need for something. Both of these situations can result in what should have been a pleasant dining experience into an irritation.

Thus, it would be advantageous if there were an apparatus or a means for enabling the restaurant goer to be able to have a signal means at the table whereby it can indicate to the waiter/waitress that service is desired or as an alternative that there is presently no need for service.

SUMMARY OF THE INVENTION

In a first aspect the present invention provides an apparatus for providing a silent signal to a waiter/waitress that one of service is required and service is not required. Said apparatus comprises a base member having a first predetermined shape and formed of a first predetermined material. A signaling member is engageable with the base member and has a second predetermined shape and formed of a second predetermined material. There is a connecting means for engaging such signaling member to the base member.

OBJECTS OF THE INVENTION

It is, therefore, one of the primary objects of the present invention to provide a means of a silent signal to the waiter/waitress that service is either required or not needed. Another object of the present invention to provide a means of a silent signal to the waiter/waitress that includes a substantially spherical signaling member that is colored red on one half and green on the other.

Still another object of the present invention to provide a means of a silent signal to the waiter/waitress that includes a light within such substantially spherical member.

Yet another object of the present invention to provide a means of a silent signal to the waiter/waitress that can be part of a condiment tray.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

Figure 1:
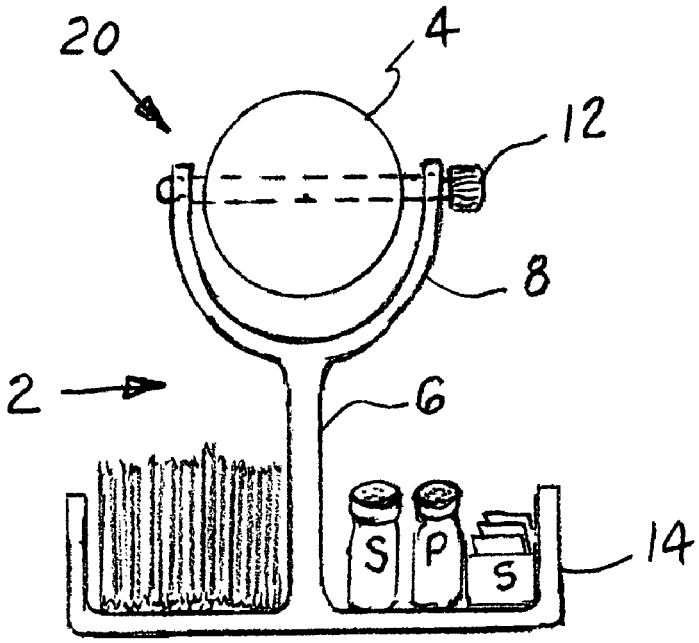
FIG. 1 is a perspective view of the apparatus according to an embodiment of the invention for signaling a waiter/waitress.
Figure 2:
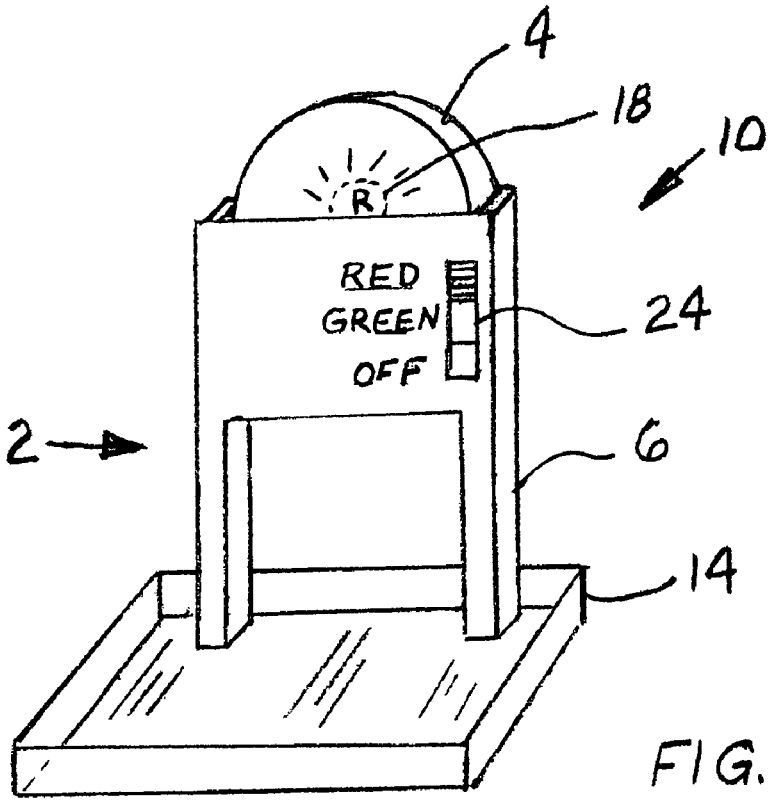
FIG. 2 is a perspective view of an alternate embodiment of the invention.
Figure 3:
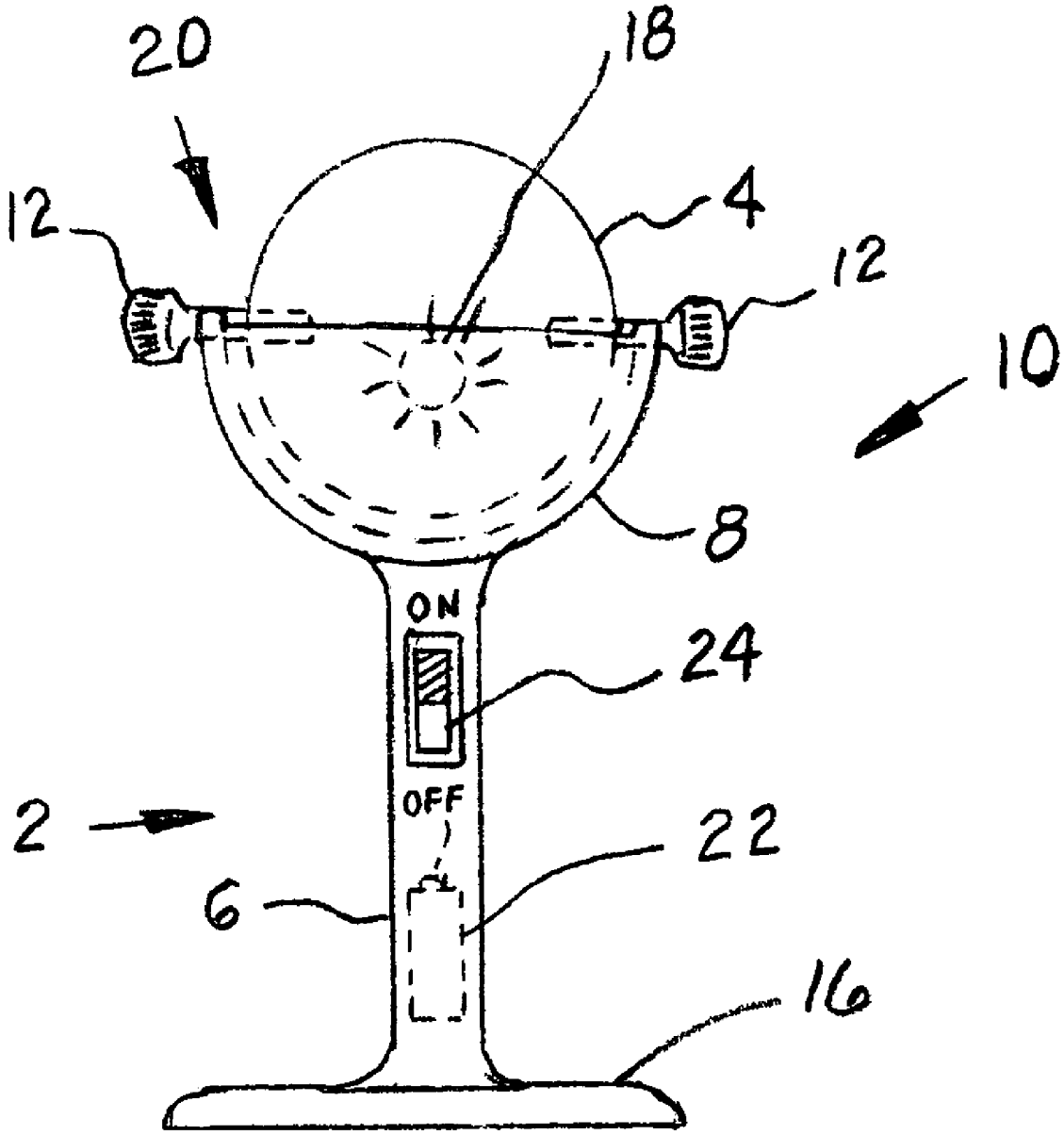
FIG. 3 is a perspective view of the apparatus for signaling a waiter/waitress according to yet another embodiment of the invention showing a light in the spherical member.

BRIEF DESCRIPTION OF THE PRESENTLY PREFERRED AND VARIOUS ALTERNATIVE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides an apparatus, generally designated 10, for providing a silent signal to a waiter/waitress that one of service is required or that service is not required. The apparatus 10 comprises a base member 2 having a first predetermined shape and formed of a first predetermined material. A signaling member, generally designated 4, is engageable with the base member 2 and has a second predetermined shape and formed of a second predetermined material. There is a connecting means, generally designated 20, for engaging such signaling member 4 to the base member 2.

Such base member 2 includes a stand portion 6 and radially opposed curved projections 8 extending upwardly from the stand portion 6. The first predetermined shape of the signaling member 4 is substantially spherical.

The connecting means 20 includes at least one pin member 12 for connecting the signaling means 20 to the curved projection 8 of base member 2. The at least one pin member 12 is disposed through a center portion of the substantially spherical signaling member 4 and engages the curved projections 8 that extend upwardly from said stand portion 6. In addition, the at least one pin member 12 includes a knurled knob at the outer end. In another embodiment the connecting means 20 includes a pair of pin members 12 engageable with the signaling member 4. In this case a respective one of the pair of pin members 12 engages a respective one of the radially opposed curved projections 8.

One half of the substantially spherical signaling member 4 is colored red and another half of the signaling member 4 is colored green. These colors are used to signal the waiter/waitress. If the red portion of the spherical signaling member 4 is on top and visible it is an indication to the waiter/waitress that the consumer is not in need of any service whereas if the half of the spherical signaling means 4 that is colored green is on top and visible then this is an indication that service is required and, requests that the waiter/waitress stop at the table.

The substantially spherical signaling means 4 is free to rotate on the pin member 12 from one half to the other half. Thus, when one half of the substantially spherical signaling member 4 that is colored green is rotated so as to be positioned with the green color on top it is as a signal to the waiter/waitress that service is required and when the half of the substantially spherical signaling member 4 that is colored red is rotated so as to be positioned with red color on top this is a signal to the waiter/waitress that service is not required.

It is within the scope of the invention that a bottom portion 14 of the stand portion 6 includes a tray for condiments. In this case the apparatus 10 is part of the amenities that are normally found on the table at a restaurant wherein the condiments such as salt, pepper, sugar and possibly sauces are normally found.

In another embodiment the bottom portion of such stand portion 6 is merely a foot 16 of the stand portion 6.

In addition to the spherical signaling member 4 being able to signal the waiter by the color that is on top such signaling member also includes at least one light 18 disposed therein. Such at least one light is at least one of a red and a green light. It is presently preferred that such light 18 is a green light. This is because it is more important that the waiter/waitress be aware that service is needed and thus the spherical signaling member 4 lights up so as to be more evident.

Such signaling member 4 further includes a power source 22 and a switch member 24. Such power source 22 provides the power to light the light 18. The switch member 24 is disposed intermediate in the circuit between the power source 22 and the light 18 so as to turn on the light when necessary or turn it off when not required. The power source 22 is a battery.

In another embodiment there are provided red and green lights 18 so that either mode is lit when required, thus the signaling member 4 exhibits a color of whichever light 18 is turned, on.

Thus, the present invention provides a silent signal to waiter/waitress that service is either required or not needed. The consumer doesn't have to wave to catch the attention of the waiter when service is needed or have to tell the waiter that we don't need service when the waiter constantly stops at the table. All the consumer has to do is turn the signaling member so that one of a green portion or a red portion is on top and the waiter/waitress knows immediately whether to stop at the table or leave the table alone without the consumer calling or watching for the waiter/waitress.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus for providing a silent signal to a waiter/waitress that one of service is required and service is not required, said apparatus comprising:

(a) a base member having a first predetermined shape and formed of a first predetermined material;

(b) a signaling member engageable with said base member, wherein said signaling member is substantially spherical and formed of a second predetermined material;

(c) a connecting means for engaging said signaling means to curved projections of said base member;

(d) a knurled knob disposed at one end of said connecting means for aiding in rotating said signaling means;

(e) wherein one half of said substantially spherical signaling member is colored green and is rotated so as to be positioned with said green color on top as a signal to a waiter/waitress that service is required; and (f) wherein another half of said substantially spherical signaling member is colored red and is rotated so as to be positioned with said red color on top as a signal to a waiter/waitress that service is not required.

2. The apparatus, according to claim 1, wherein said base member includes a stand portion.

3. The apparatus, according to claim 2, wherein said curved projections are radially opposed curved projections extending upwardly from said stand portion.

4. The apparatus, according to claim 3, wherein said connecting means includes at least one pin member disposed through a center portion of said substantially spherical signaling member and engages said curved projections extending upwardly from said stand portion.

5. The apparatus, according to claim 3, wherein said connecting means includes a pair of pin members engageable with said signaling member.

6. The apparatus, according to claim 5, wherein a respective one of each of said pair of pin members engages a respective one of said radially opposed curved projections.

7. The apparatus, according to claim 6, wherein said substantially spherical signaling means is free to rotate on said pin member from one half to another half.

8. The apparatus, according to claim 2, wherein a bottom portion of said stand portion includes a tray for condiments.

9. The apparatus, according to claim 1, wherein said signaling member includes at least one light disposed therein.

10. The apparatus, according to claim 9, wherein said at least one light is at least one of a red and a green light.

11. The apparatus, according to claim 9, wherein said at least one light is a green light.

12. The apparatus, according to claim 9, wherein said signaling member further includes a power source and a switch member.

13. The apparatus, according to claim 9, wherein said power source is a battery.

14. The apparatus, according to claim 9, wherein said signaling member includes two lights.

15. The apparatus, according to claim 10, wherein said signaling member exhibits a color of whichever light is turned on.

* * * * *